US007905639B2

(12) United States Patent
Luo et al.

(10) Patent No.: US 7,905,639 B2
(45) Date of Patent: Mar. 15, 2011

(54) SIDE-LOADED LIGHT EMITTING DIODE MODULE FOR AUTOMOTIVE REAR COMBINATION LAMPS

(75) Inventors: Hong Luo, Danvers, MA (US); ZhaoHuan Liu, Mississauga, CA (US)

(73) Assignee: Osram Sylvania Inc., Danvers, MA (US)

( * ) Notice: Subject to any disclaimer, the term of this patent is extended or adjusted under 35 U.S.C. 154(b) by 101 days.

(21) Appl. No.: 12/259,633

(22) Filed: Oct. 28, 2008

(65) Prior Publication Data

US 2009/0296418 A1 Dec. 3, 2009

Related U.S. Application Data

(60) Provisional application No. 61/056,738, filed on May 28, 2008.

(51) Int. Cl.
*F21V 7/06* (2006.01)
*F21V 7/00* (2006.01)

(52) U.S. Cl. ... 362/487; 362/555; 362/545; 362/249.11; 362/249.02

(58) Field of Classification Search ..... 362/487, 362/545, 555, 346, 348, 350, 294, 518, 517, 362/519
See application file for complete search history.

(56) References Cited

U.S. PATENT DOCUMENTS

| | | | | |
|---|---|---|---|---|
| 3,700,883 | A | 10/1972 | Donohue et al. | |
| 4,704,661 | A | 11/1987 | Kosmatka | |
| 5,406,464 | A | 4/1995 | Saito | |
| 5,539,629 | A | 7/1996 | Chinniah et al. | |
| 6,474,852 | B1 | 11/2002 | Ohkohdo et al. | |
| 6,637,921 | B2 | 10/2003 | Coushaine | |
| 6,637,923 | B2 | 10/2003 | Amano | |
| 6,814,475 | B2 | 11/2004 | Amano | |
| 6,945,672 | B2 | 9/2005 | Du et al. | |
| 6,951,414 | B2 | 10/2005 | Amano | |
| 6,991,355 | B1 | 1/2006 | Coushaine et al. | |
| 7,042,165 | B2 | 5/2006 | Madhani et al. | |
| 7,075,224 | B2 | 7/2006 | Coushaine | |
| 7,110,656 | B2 | 9/2006 | Coushaine et al. | |
| 7,158,019 | B2 * | 1/2007 | Smith | 340/467 |
| 7,621,667 | B2 * | 11/2009 | Behr et al. | 362/651 |

* cited by examiner

*Primary Examiner* — Anabel M Ton
(74) *Attorney, Agent, or Firm* — Shaun P. Montana; Yiming Zhang

(57) ABSTRACT

A side-loading LED module for a rear combination lamp is disclosed. One or more LEDs are mounted on a distal side of a printed circuit board, which also includes the circuitry that drives the one or more LEDs. The circuit board and a thermal pad are screwed/riveted to a heat sink, then the heat sink is mounted to a lateral face of a housing. The LEDs emit diverging light laterally inside the housing. One face of the housing is a faceted parabolic reflector, which receives the diverging light from the LEDs and reflects a collimated beam longitudinally to the front of the housing, where it passes through a clear cover and exits the lamp. The facets on the parabolic reflector angularly deviate portions of the reflected beam, so that the reflected light is collimated, and is angularly broader than a single collimated beam.

19 Claims, 5 Drawing Sheets

SIDE-LOADED LIGHT EMITTING DIODE MODULE FOR AUTOMOTIVE REAR COMBINATION LAMPS

CROSS-REFERENCE TO RELATED APPLICATIONS

The present application claims priority under 35 U.S.C §119(e) to provisional application No. 61/056,738, filed on May 28, 2008 under the title, "Side entry LED light module for automotive rear combination lamp," and incorporated by reference herein in its entirety. Full Paris Convention priority is hereby expressly reserved.

STATEMENT REGARDING FEDERALLY SPONSORED RESEARCH OR DEVELOPMENT

Not Applicable

BACKGROUND OF THE INVENTION

1. Field of the Invention

The present invention is directed to rear combination lamps for automotive lighting systems.

2. Description of the Related Art

For many years, automobiles have employed electric lighting that serves a variety of functions. For instance, lights provide forward illumination (headlamps, auxiliary lamps), conspicuity (parking lights in front, taillights in rear), signaling (turn signals, hazards, brake lights, reversing lights), and convenience (dome lights, dashboard lighting), to name only a few applications. Historically, incandescent bulbs have been used for most or all lighting in an automobile, being available in a variety of sizes, shapes, wattages, and socket packages.

In recent years, light emitting diodes (LEDs) have started to appear in some of the lighting applications for automobiles. Compared with incandescent bulbs, LEDs use less power, last longer, and have less heat output, making them well suited for automotive applications.

The spectral requirements on the automobile external lighting are well satisfied by many LEDs. For older incandescent lighting, the spectral requirements were typically addressed by a colored lens, cover or frame in front of a white-light incandescent bulb. For LEDs, the output wavelength range may be tailored to the lighting requirement. For instance, red and amber lights may use LEDs with narrow-band outputs in the red and amber portions of the spectrum, respectively. For white-light applications, LEDs that use illumination of a broadband phosphor are becoming more widespread.

The temporal requirements on the lighting, such as the rise time of a brake light, are quite well suited to LEDs, which typically have rise times that are shorter than comparable incandescent bulbs.

The spatial requirements for external lighting may vary with geographical region, but they are typically defined fairly precisely for each external lighting element. For instance, a left headlight should have a particular well-defined emission pattern as a function of exiting angle, in both lateral and vertical directions, a right headlight should have a different but equally well-defined emission pattern, and so forth.

These spatial requirements have been developed for typical incandescent bulbs or lamps. In general, a typical incandescent lamp includes an extended (i.e., non-point-source) filament that radiates light outward uniformly in all directions. The lamp is typically housed in a fixture that includes one or more reflective elements that can direct the light away from the automobile. For some applications, there may also be some collimating elements, which may be separate from the reflector, or partially or wholly integrated into the reflector.

Unlike typical incandescent lamps, LEDs have a light output that varies with direction. The light output from an LED may peak in a particular direction, and may roll off with a particular angular profile away from the peak. For instance, a typical LED may have a particular FWHM angular profile, or other suitable angular measure of its output. The angular output may be symmetrical in two dimensions, or may be asymmetric in two dimensions.

Because there are spatial differences in output between LEDs and typical bulbs or lamps, it may not be feasible to simply swap an LED for an incandescent lamp in a particular lighting element; to do so may undesirably alter the angular output from the element. Using LEDs may require new designs for the reflectors and other optical elements, so that the spatial output from the lighting element matches the existing requirements that were developed for incandescent lamps.

In the few years since LEDs have been introduced as lighting sources, automakers have adopted a cautious position. While they have been eager to adopt LEDs for all of the advantages stated above, they have been hesitant to completely abandon the familiarity of a bulb/lamp with a socket and its accompanying traditional-style optics. As a result, in recent years there have been several lighting subsystems that have the mechanical feel of the old incandescent-style bulbs and fixtures, but actually use LEDs as their light sources.

FIG. 1 shows a typical automobile 1, with typical exterior lights that front turn indicators 2, include headlamps 3, fog lamps 4, side repeaters 6, a center high mounted stop lamp 7, a license plate lamp 8, and so-called "rear combination lamps" 9 (RCLs). Any or all of these may include accessories, such as a headlamp cleaning system 5. We concentrate primarily on the rear combination lamps 9 for this application.

Note that each rear combination lamp 9 may include a tail light (also known as a marker light), a stop light (also known as a brake light), a turn signal light, and a back up light. Each light in the rear combination lamp may have its own light source, its own reflection and/or focusing and/or collimation and/or diffusing optics, its own mechanical housing, its own electrical circuitry, and so forth. In this respect, an aspect or feature of one particular light may be used for any or all of the lights in the rear combination lamp 9. Optionally, one or more functions may be shared among lights, such a circuit that controls more than one light source, or a mechanical housing that holds more than one light source, and so forth. For instance, each lighting sub-system typically has its own independent lamp, although the tail light and stop light functions may be combined in a single lamp (bulb) having a double filament.

In recent years, as LEDs have started to appear in exterior automotive lighting systems, one trend is to integrate the LEDs closely into the fixture. For instance, the center high mount stop lamps 7, or CHSMLs, are now mostly done in this fashion as it was relatively easy to adapt an LED module to the application. Because of the long life of LEDs, this may be the favored approach over time.

In other words, in the long term, the light fixtures, including the housing, the reflectors, the lens cover and any intermediate optical elements, will most likely become adapted to a configuration that is designed optimally around the LED. The electrical connections, the heat sink, the collimation and/or reflection and/or diffusing optics will most likely have designs that are primarily suited to LEDs, rather than primarily to conventional incandescent bulbs or lamps and then modified to include LED light sources.

However, in the short term, many automakers prefer familiar and known technology, including known reflector and bulb geometries that were developed for incandescent lamps and have been used for many years. As a result, several lighting manufacturers have developed rear combination lamp systems that use LEDs as their light sources, but use conventional light set socket openings and traditional style optics. These lamp systems are appealing to automakers in the short term because the mechanical aspects of the lamp systems are consistent with the older, established systems that use incandescent bulbs. An example of such a lamp system is the JOULE product, which is commercially available from Osram Sylvania, based in Danvers, Mass.

Because the present application is directed to automotive lighting systems, it is beneficial to first review some terminology.

The parts that make up the lighting systems at the corners of vehicles are known as "light sets". In buildings, the equivalent of "light sets" would be fixtures. A light set typically includes a plastic structure or housing, one or more reflectors, lens optical systems in some cases, and a lens cover usually fitting the exterior styling of the vehicle and often having colored sections, such as amber and red. The housing of the light set includes socket openings, usually in the rear, to receive and retain a socket with a lamp (commonly referred to in the U.S. as a "bulb"), venting means, and in some cases for forward lighting, adjuster means.

The lamp (bulb) may be replaced in one of two ways: (a) Accessing the back of the light set, moving the socket and lamp, removing the lamp, fitting a new lamp, and reinstalling the socket, or (b) Removing the lens cover from the front of the light set, removing the lamp from the socket, inserting a new lamp and then reinstalling the lens cover.

Option (a) is disfavored for a number of reasons, including access issues, styling issues, mechanical depth issues, and sealing the light set to the body issues.

Option (b) is disfavored for several reasons as well, including the following two: (1) It is preferable to have a more permanent seal between the light set and the lens cover. This reduces cost and complexity, and ensures an effective seal against dirt and water, and (2) The mechanics of a removable lens cover is difficult, due to fit and styling issues.

Because accessing the back of the light set for lamps is disfavored, it may be desirable to move the socket opening to the side, especially for a rear combination lamp 9.

Three lighting systems that have sockets that open to the side are disclosed in, for example, U.S. Pat. Nos. 6,637,923, 6,814,475 and 6,951,414, all issued to Amano and assigned to Koito Manufacturing Co., and all incorporated by reference in their entirety herein. All three include an element adjacent to the LED that collimates the beam, and then a separate element that receives the collimated beam and reflects the collimated beam outward away from the automobile.

One potential drawback to the lighting systems of these three references is that two separate elements are used to collimate and then reflect the beam. These separate elements may be costly to fabricate, costly and time-consuming to align, and may introduce unnecessary loss into the optical system (i.e., some light may be absorbed, reflected and/or scattered out of the output beam by the multiple elements).

Accordingly, there exists a need for an automotive lighting system having a reduced number of elements, which may provide a less complicated optical system that may be easier to align and have a higher output power (less loss) than the optical systems disclosed in the references above. The automotive lighting system should have one or more sockets that open to the side, rather than the rear, of the light set.

In general, there are four key elements for an LED-based lighting module: (1) the actual LED chip or die, (2) the heat sink or thermal management, which dissipates the heat generated by the LED chip, (3) the driver circuitry that powers the LED chip, and (4) the optics that receives the light emitted by the LED chip and directs it toward a viewer. These four elements need not be redesigned from scratch for each particular module; instead, a particular lighting module may use one or more elements that are already known. The following paragraphs describe several of these known elements, which may be used with the LED-based lighting module disclosed herein.

U.S. Pat. No. 7,042,165, titled "Driver circuit for LED vehicle lamp", issued to Madhani et al., and assigned to Osram Sylvania Inc. of Danvers, Mass., discloses a known driver circuit for LED-based lighting modules, and is incorporated by reference herein in its entirety. In '165, a first vehicle lamp driver circuit for a light emitting diode (LED) array is disclosed, the LED array having a first string of four LEDs in series and a second string of four LEDs in series. A first LED driver drives the first LED string and a second LED driver drives the second LED string. In a STOP mode of operation, the current to both LED strings is controlled by the LED driver in series with the LED string. In a TAIL mode of operation, the current is provided to only one LED string via a series connected diode and resistor. When there is reduced input voltage, operation of the LED strings is provided by switching circuits that short-out one LED in each LED string. A second vehicle lamp driver circuit comprises a first LED string and a second LED string in series with a control switch having a feedback circuit for maintaining constant current regulation to control the sum of the current in each LED string and reduce switching noise. The driver circuit disclosed by '165 may be used directly or may be easily modified to drive the LED chip for the lighting module disclosed herein.

U.S. Pat. No. 7,110,656, titled "LED bulb", issued to Coushaine et al., and assigned to Osram Sylvania Inc. of Danvers, Mass., discloses a complementary socket and electrical connector mechanical structure for LED-based lighting modules, and is incorporated by reference herein in its entirety. In '656, an LED light source has a housing having a base. A hollow core projects from the base and is arrayed about a longitudinal axis. A printed circuit board is positioned in the base at one end of the hollow core and has a plurality of LEDs operatively fixed thereto about the center thereof. In a preferred embodiment of the invention the hollow core is tubular and the printed circuit board is circular. A light guide with a body that, in a preferred embodiment, is cup-shaped as shown in FIGS. 2 and 4*a*, has a given wall thickness "T". The light guide is positioned in the hollow core and has a first end in operative relation with the plurality of LEDs and a second end projecting beyond the hollow core. The thickness "T" is at least large enough to encompass the emitting area of the LEDs that are employed with it. The complementary socket and electrical connector mechanical structure disclosed by '656 may be used directly or may be easily modified for the lighting module disclosed herein.

U.S. Pat. No. 7,075,224, titled "Light emitting diode bulb connector including tension receiver", issued to Coushaine et al., and assigned to Osram Sylvania Inc. of Danvers, Mass., discloses another complementary socket and electrical connector mechanical structure for LED-based lighting modules, and is incorporated by reference herein in its entirety. In '224, an LED light source (10) comprises a housing (12) having a base (14) with a hollow core (16) projecting therefrom. The core (16) is substantially conical. A central heat conductor (17) is centrally located within the hollow core (16) and is formed from solid copper. A first printed circuit board (18) is connected to one end of the central heat conductor and a second printed circuit board (20) is fitted to a second, opposite end of the central heat conductor (17). The second printed circuit board (20) has at least one LED (24) operatively fixed thereto. A plurality of electrical conductors (26) has proximal ends (28) contacting electrical traces formed on the second printed circuit board (20) and distal ends (30) contacting electrical traces on the first printed circuit board (18). Each of the electrical conductors (26) has a tension reliever (27) formed therein which axially compresses during assembly. A cap (32) is fitted over the second printed circuit board (20); and a heat sink (34) is attached to the base and in thermal contact with the first printed circuit board. As with '656, the complementary socket and electrical connector mechanical structure disclosed by '224 may be used directly or may be easily modified for the lighting module disclosed herein.

U.S. Pat. No. 6,637,921, titled "Replaceable LED bulb with interchangeable lens optic", issued to Coushaine, and assigned to Osram Sylvania Inc. of Danvers, Mass., discloses a reflective optic that can receive light from an LED, emitted perpendicular to a circuit board, and reflect it in a number of directions, all roughly parallel to the circuit board. The optic disclosed by '921 may have the shape of an inverted cone, with the point of the cone facing the LED chip. The cone may be continuous, or may alternatively have discrete facets that approximate the shape of a cone. The reflective optic may be used with a single LED chip, or multiple LED chips arranged around the point of the cone. The reflective optic disclosed by '921 may be used with the LED-based lighting module disclosed herein, and may be disposed in the optical path between the LED chip and the reflector that directs the LED light towards a viewer.

BRIEF SUMMARY OF THE INVENTION

An embodiment is a vehicular lamp (10), comprising: a thermally conductive module (21, 121) having a longitudinal axis and being insertable into a housing (20) along the longitudinal axis; a printed circuit board (41, 141) in mechanical and thermal contact with the thermally conductive module (21, 121), the printed circuit board (41, 141) being oriented generally perpendicular to the longitudinal axis; at least one light emitting diode (44, 144) mounted on the printed circuit board (41, 141) and controlled electrically by the printed circuit board (41, 141) for emitting a diverging beam (12) generally parallel to the longitudinal axis; and a curved and faceted reflector (13) for receiving the diverging beam (12) and reflecting a generally collimated beam (14) generally perpendicular to the longitudinal axis. The curvature of the reflector (13) collimates the received diverging beam (12). Each facet on the reflector (13) angularly diverts a corresponding portion of the reflected collimated beam (14) into a predetermined angular range.

Another embodiment is a vehicular lamp (10), comprising: a light emitting diode (44, 144) for emitting a diverging beam (12) along an optical axis; a generally planar printed circuit board (41, 141) for powering the light emitting diode (44, 144) and for mechanically mounting the light emitting diode (44, 144), the printed circuit board (41, 141) being generally perpendicular to the optical axis; a generally cylindrical module (21, 121) in mechanical and thermal contact with the circuit board (41, 141), the module (21, 121) having a cylindrical axis generally parallel to the optical axis; a fixture (20) for mounting the module (21, 121), the module (21, 121) being mounted so that the cylindrical axis is horizontal and is generally parallel to a front of the fixture; a reflector (13) for receiving the diverging beam (12) and emitting a generally collimated beam (14) generally perpendicular to the front of the fixture (20); and a transparent cover (15) for transmitting the generally collimated beam (14).

A further embodiment is a vehicular lamp (10), comprising: a light emitting diode (44, 144) for emitting a diverging beam (12) along a lateral direction; a reflector (13) for receiving the diverging beam (12) and reflecting a generally collimated beam (14) along a longitudinal direction, the longitudinal direction being generally perpendicular to the lateral direction; a transparent cover (15) for transmitting the generally collimated beam (14) in the longitudinal direction; and a module (21, 121) for mechanically mounting, electrically powering and thermally connecting to the light emitting diode (44, 144). The module (21, 121) is laterally mounted and comprises: a heat sink; a printed circuit board (41, 141) for electrically powering the light emitting diode (44, 144), the circuit board (41, 141) being generally planar and perpendicular to the lateral direction; and a thermal pad or thermal grease (31, 131) disposed between the printed circuit board (41, 141) and the heat sink for providing thermal contact and electrical insulation between the printed circuit board (41, 141) and the heat sink.

DETAILED DESCRIPTION OF THE INVENTION

Figure 1:
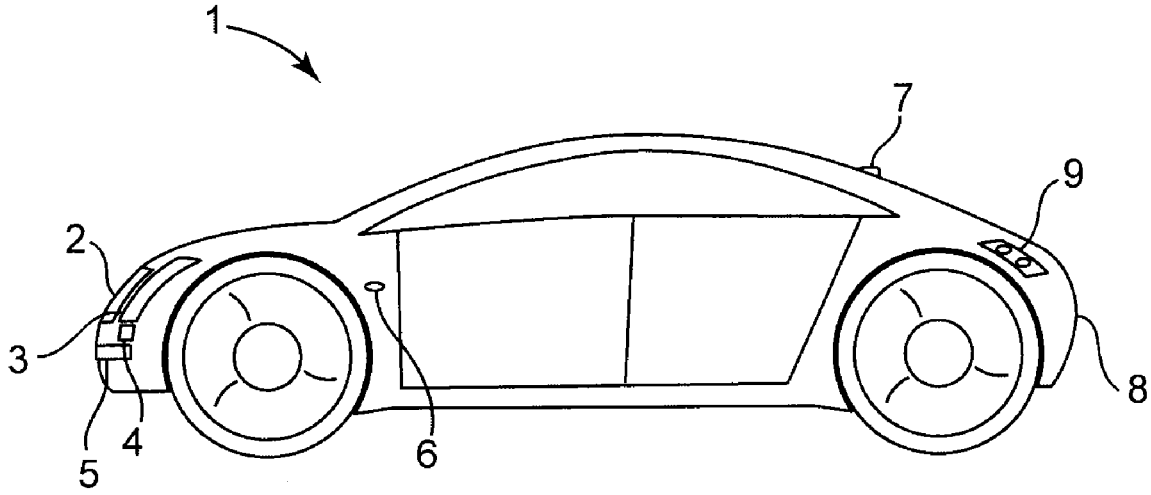
FIG. 1 is a schematic drawing of the exemplary external lighting of an automobile.

The light emitting diode (LED) module disclosed herein may be used for exterior vehicle lighting. The LED module may be installed in a light set socket from the side, rather than from the back. The LED module may include optical elements suitable to distribute the light to a reflector that receives light from the LED chip(s) and directs the reflected light toward a viewer. Because the LED module may be installed from the side, rather than the back, the reflector may be more compact than in conventional reflector designs. This is disclosed more fully in the detailed description below.

For typical, known rear combination lamps that use light emitting diodes as their light sources, there have been numerous ways of ensuring that the output light exits the device with the proper orientation. For instance, the first generation system commercially available with the name JOULE used light emitting diodes mounted at a particular angle. The assembly process for this first generation system was undesirably complicated, and included a difficult connection between the LEDs and control circuit boards. For the second generation JOULE system, this mounting scheme for the light emitting diodes was replaced with a light guide and a small reflector that image the emission point of the LED onto the focal point of the rear combination lamp reflector. The light guide is typically a transparent tube of glass or plastic, with smooth sides that ensure that a beam transmitted along the light guide experiences total internal reflection at each reflection off the sides. The light guide, while an improvement over the first generation product, is still an extra component in the system, thereby increasing the cost of the system, and is still lossy, losing a fraction of light at the entering and exiting interfaces of the light guide. Additional LEDs were required to overcome the losses introduced by the light pipe and associated optics. A system using side-emitting light emitting diodes has also been tried, but also had either assembly difficulties or a low optical efficiency.

In general, all of the previous rear combination lamps exhibit some sort of deficiency, whether it is a difficulty in assembly, a low optical efficiency, or an incompatibility with current housings for rear combination lamps.

The present invention overcomes these deficiencies and may provide one or more of the following advantages:

First, the light emitting diode module is fully integrated, thereby reducing the number of components and simplifying the assembly of the module. Furthermore, because the light emitting diodes and electronics are on the same board, there is no need for an additional interconnection between them.

Second, the light emitting diode module is backwards-compatible, and has optical and mechanical characteristics that match, or are readily adaptable to, those of current rear combination lamp housings. In this case, the socket may be used as a heat sink. If additional heat sinking is needed, thermal pins or fins may be added on the back of the printed circuit board.

Third, the loss of the LED module is reduced, thereby increasing the brightness of the module and/or reducing the amount of electrical power required to operate the module and/or reducing the number of LEDs needed. A light pipe or any additional optics is not needed.

We provide a brief summary of the disclosure in the following ten paragraphs, followed by a detailed description of the optical path in the rear combination lamp, followed by a detailed description of the mechanical aspects of the rear combination lamp.

A side-loading LED module for a rear combination lamp is disclosed. One or more LEDs are mounted on a distal side of a printed circuit board, which also includes the circuitry that drives the one or more LEDs. The LEDs emit beams that propagate generally perpendicular to the circuit board, in the distal direction. The LEDs may be referred to as "APTs".

The circuit board may include one or more connector pins, which extend generally through the circuit board, perpendicular to the circuit board, and provide electrical power and/or monitoring to and/or from the circuit board. The connector pins may include a plastic connector attached to the pins on the proximal side of the circuit board.

Adjacent to the proximal side of the circuit board is a gap pad or a thermal pad and/or an optional thin layer of thermal grease, which can dissipate heat generated by the circuit board and/or LEDs, and/or may provide electrical insulation between the circuit board and the metal socket. The gap pad may have a hole in it to accommodate the connector on the proximal side of the circuit board.

Adjacent to the gap pad, opposite the circuit board, is a casting socket. The casting socket may be made from a thermally conductive material, such as aluminum, and may include optional fins or other heat sink elements on the side opposite the gap pad. In some applications, some or all of the casting socket, the gap pad and the circuit board may include alignment features (42, 32, 22) that help to align them during assembly. Once aligned, the circuit board, the gap pad, and the casting socket can be screwed or riveted together. In some applications, some or all of the casting socket may include one or more quarter turn features, which are widely used in automotive rear lamps. With these quarter-turn features, the module may be easily pushed into the lamp housing, then rotated one quarter turn, thereby fixing and holding the module to the lamp housing. These quarter-turn features are relatively inexpensive, reliable, and appropriate for automotive tail lamps, and allow the module to be interchangeable during use or when a lamp fails.

Once screwed/riveted together, the socket/thermal pad/circuit board may be attached to the rest of the fixture from the side of the fixture. The fixture includes a hole or aperture or a quarter turn adapter on its side, facing the center of the vehicle. The socket/thermal pad/circuit board is inserted into the aperture, with its LEDs and their output beams facing the left and/or right sides of the vehicle (away from the center of the vehicle).

The light exiting the LEDs is divergent, with a particular angular pattern characterized by the LEDs themselves. Each LED emits a beam that travels away from the center of the vehicle, generally parallel to the ground. The fixture includes a curved reflector that collimates the light from the LEDs, and reflects the collimated light from the rear of the vehicle, roughly parallel to the ground.

The shape of the reflector may be a half-paraboloid, with the LEDs being located at or near the focus of the paraboloid. If there are two or more LEDs, the light from each LED may be collimated and reflected by the reflector in the fixture, but light from the two LEDs may emerge at slightly different angles, given by the lateral separation of the LEDs divided by the focal length of the parabolic reflector. In general, the emission pattern from the fixture should conform to a particular legal requirement that may dictate the angular profile of the emergent light in two dimensions.

The reflector in the fixture may be faceted, so that the light emerging from the fixture may satisfy a particular predetermined angular requirement. Such faceting of the reflector is known, and is described in greater detail below.

Simulations were performed, prototypes were built, and measurements of power (or flux, in lumens) were taken and were found to agree with the simulations.

In some embodiments, the module and/or socket parts may act as a heat sink. Either or both may be made out of aluminum, or other suitable heat-conducting material, to move heat away from the fixture.

Having provided a brief summary of the disclosure, we next provide a discussion of the optical path in the rear combination lamp, followed by a more detailed discussion of the mechanical implementation of the optical components.

Figure 2:
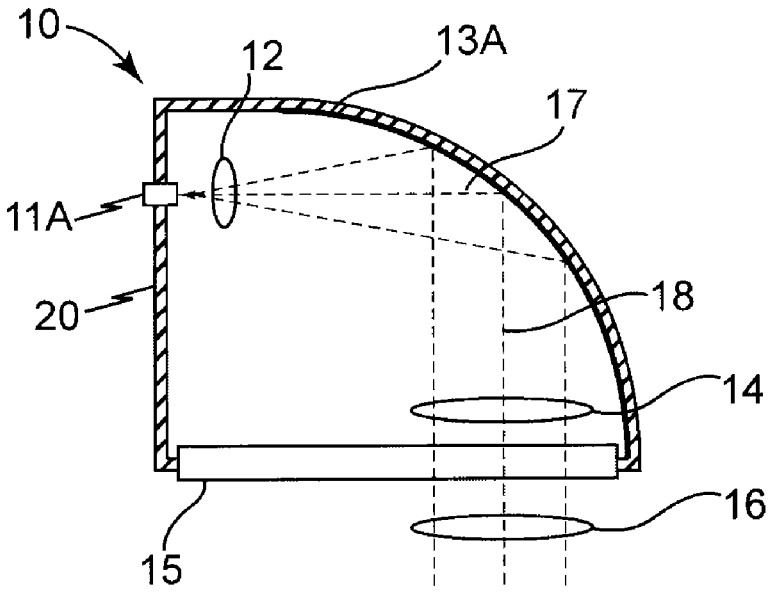
FIG. 2 is a cross-sectional schematic drawing of a simplified optical path in a rear combination lamp, having a single LED and an un-faceted reflector.

FIG. 2 is a cross-sectional schematic drawing of a simplified optical path in a rear combination lamp 10. An LED module 11A emits a diverging beam 12 laterally, toward the side of the rear combination lamp 10. The diverging beam has a peak brightness along a particular direction, denoted here as an optical axis 17.

The diverging beam 12 may be characterized by a particular angular distribution or an angular width, which describes how quickly the beam's brightness decreases, as a function of angle. For instance, the diverging beam may have a characteristic full-width-at-half-maximum (FWHM) for its intensity or brightness, or a half-width-at-1/e^2-in-intensity, or any other suitable angular width. The characteristic angular widths of the diverging beam may be the same or may be different along the x- and y-directions, where the optical axis may be considered to be the z-direction. The size of the diverging beam grows as it propagates along the optical axis 17, roughly in proportion to the distance from the LED module 11A.

In this simplified optical path of FIG. 2, there is only a single LED in the LED module 11A. In practice, there may be more than one LED in the module; this case is treated explicitly following the discussion of the simplified system in FIG. 2.

The diverging beam 12 strikes a reflector 13A, which collimates the beam and reflects a collimated beam 14 longitudinally, toward the front of the rear combination lamp 10.

The reflector 13A may have the shape of a paraboloid, which is parabolic in a cross-section that includes its vertex. It is known that parabolic reflectors form a virtually aberration-free collimated beam from a light source placed at the focus of the paraboloid. Longitudinal shifting of the source away from the focus may produce defocus, or deviation away from collimation, or, equivalently, deviation of the light flux away from parallelism. Lateral shifting of the source away from the focus may produce a pointing error of the reflected collimated beam. In other words, for a laterally shifted source, the reflected beam is still collimated, but the reflected beam may angularly deviate from the un-shifted case. In general, the value of such an angular shift, in radians, equals the lateral shift of the source, divided by the focal length of the parabolic reflector. For large enough lateral shifts away from the focus, the reflected beam may also exhibit monochromatic wavefront aberrations, such as coma.

For an old-style reflector that used incandescent bulbs, the bulb was typically placed at the focus of a parabolic reflector, symmetrically, from the back of the reflector. The reflector typically surrounded the bulb, with an opening toward the front of the fixture. Because an incandescent bulb radiated light into all directions (except toward the socket), it was useful to surround the bulb azimuthally, so that as much radiated light as possible was directed into the collimated beam emerging from the parabolic reflector.

In contrast, for parabolic reflectors that use LEDs as their light sources, it is not necessary to use the full, 360-degree azimuthally-complete paraboloid to capture all the light radiated from the source. Because LEDs radiate into a relatively small solid-angle cone, compared with incandescent bulbs, one need only use a portion of the paraboloid that the sufficiently captures the full spatial extent of the beam at the reflector. As a result, the reflector 13A may be a fraction of a paraboloid, such as a half-paraboloid, or other suitable paraboloid portion. Note that a half-paraboloid may be visualized by bisecting the full paraboloid by a plane that extends through its vertex and its focus. Optically, such a fraction of a paraboloid works sufficiently well to capture the diverging light from the source, and uses less volume and less material than a full paraboloid would.

In FIG. 2, one may consider the optical axis to bend at the reflector, so that for the collimated beam, the optical axis 18 may be oriented largely longitudinally, toward the front of the rear combination lamp 10. In some applications, the optical axis 17, 18 may bend by 90 degrees at the reflector. In other applications, it may bend by slightly more than 90 degrees or slightly less than 90 degrees. For all of these cases, we may refer to the diverging beam 12 as having a "largely" lateral orientation, and collimated beam 14 as having a "largely" longitudinal orientation.

The collimated beam 14 may be commonly referred to in the literature as "parallel light flux". These terms are interchangeable, and may be considered equivalent as used in this application.

After passing through a transparent or translucent "clear cover" or "lens cover" 15, the collimated beam 14 remains collimated 16, and exits the rear combination lamp 10 at the rear of the automobile, toward the viewer. The clear cover 15 may have an optional spectral effect, such as filtering one or more wavelengths or wavelength bands from the transmitted light, but typically does not scatter the beam, as a diffuser would.

The LED module 11A, the reflector 13A, and the clear cover 15 may all be held mechanically by a housing 20. Such a housing 20 may be desirable in that it can be manufactured inexpensively, and may be molded or stamped to include the surface profile of the reflector 13. The mechanical aspects of the rear combination lamp 10 are discussed in much greater detail below, following the current description of the optical path.

The simplified rear combination lamp 10 of FIG. 2 may require some modifications before it can meet the legal requirements for a rear combination lamp; recall that those requirements were defined for incandescent lamps, and that new LED-based lamps may be designed to have their outputs "look like" those from incandescent-style fixtures, in order to meet the old requirements.

For instance, the rear combination lamp may require more light output power than is possible or convenient from a single LED. Such a multi-LED is shown schematically, in simplified form, in FIG. 3.

Compared with the rear combination lamp 10 of FIG. 2, the only different component is a multi-LED module 11B, which includes three LEDs. In this simplified schematic, the LEDs all emit light in roughly the same direction, to within typical manufacturing, assembly and/or alignment tolerances. In other applications, one or more LEDs may point in different directions.

The light from each of the three LED sources on the multi-LED module 11B is traced throughout the rear combination lamp 10, so there are three sets of dashed lines to represent the beam. The effect of having multiple, spatially separated sources, in such a system is that there may be some small angular deviation of some rays in beam 16 away from the optical axis 18. Such angular deviation is typically small, such as on the order of only a few degrees, and the output beam 16 is still considered to be collimated.

From an optics perspective, it is desirable to have the LEDs as close together as possible. However, from a thermal perspective, it is desirable to have the LEDs as far apart as possible, so that the heat generated by each LED may be dissipated efficiently. In practice, the LEDs may be spaced apart on a printed circuit board by up to a few mm or more. The thermal aspects of the rear combination lamp 10 are discussed more fully below, following the current description of the optical path.

Figure 3:
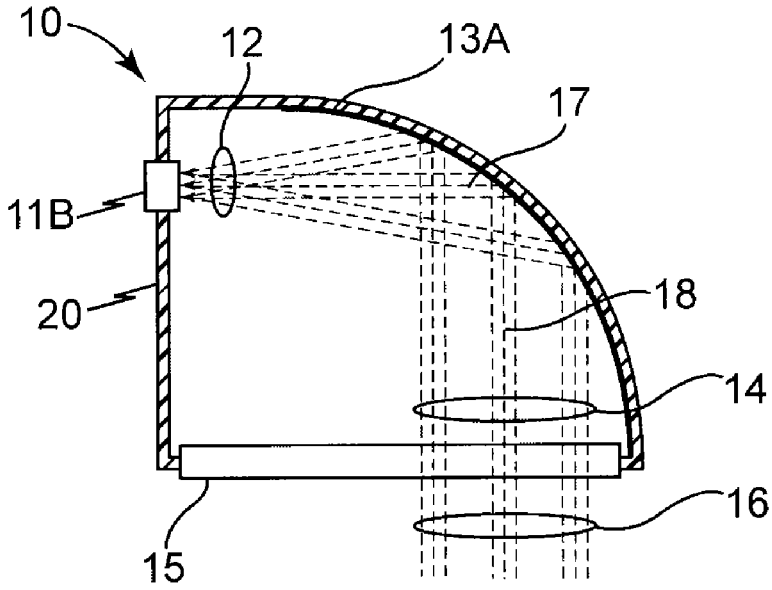
FIG. 3 is a cross-sectional schematic drawing of a simplified optical path in a rear combination lamp, having multiple LEDs and an un-faceted reflector.

The simplified rear combination lamp 10 of FIG. 3 may have sufficient output optical power to meet the appropriate legal requirements, but it may not have a suitable angular distribution of light in the output beam 16. In other words, the output beam 16 may be too strongly directional, so that if a viewer's line of sight is outside the relatively narrow output beam 16, the lamp may not appear bright enough.

This may be understood more clearly by examining the lamp output angular requirements and their evolution from the output of incandescent bulbs. Light emerging from an old-style reflector fixture includes two portions that are superimposed: (1) Light that travels from the bulb directly out the clear cover, and (2) Light from the bulb that reflects off the parabolic reflector. Portion (1) is diverging, while portion (2) is generally collimated. The combination of these two portions, in the space away from the automobile, has an angular dependence, with the intensity being greater when the viewer's line of sight is within the collimated beam from portion (2). However, the angular dependence is dampened by the relative weak angular dependence of portion (1). According to Federal regulations for rear combination lamps, typical cutoff values for angular output evolved to be about +/−10 degrees in the vertical direction and about +/−20 degrees laterally, so that the light from the lamp could be adequately seen if a viewer's line of sight is "within" the angular cutoff, but not necessarily need to be seen if the viewer's line of sight is outside the angular cutoff.

As a result, the output beam 16 from the simplified rear combination lamp 10 of FIG. 3 may be too narrow to meet the angular requirements of about +/−10 degrees vertically and about +/−20 degrees laterally, since its angular extent may be only +/− a few degrees at most. A known element that was developed for angularly broadening a beam without significantly altering its collimation is shown in FIG. 4, and may be referred to as a "faceted" reflector.

Figure 4:
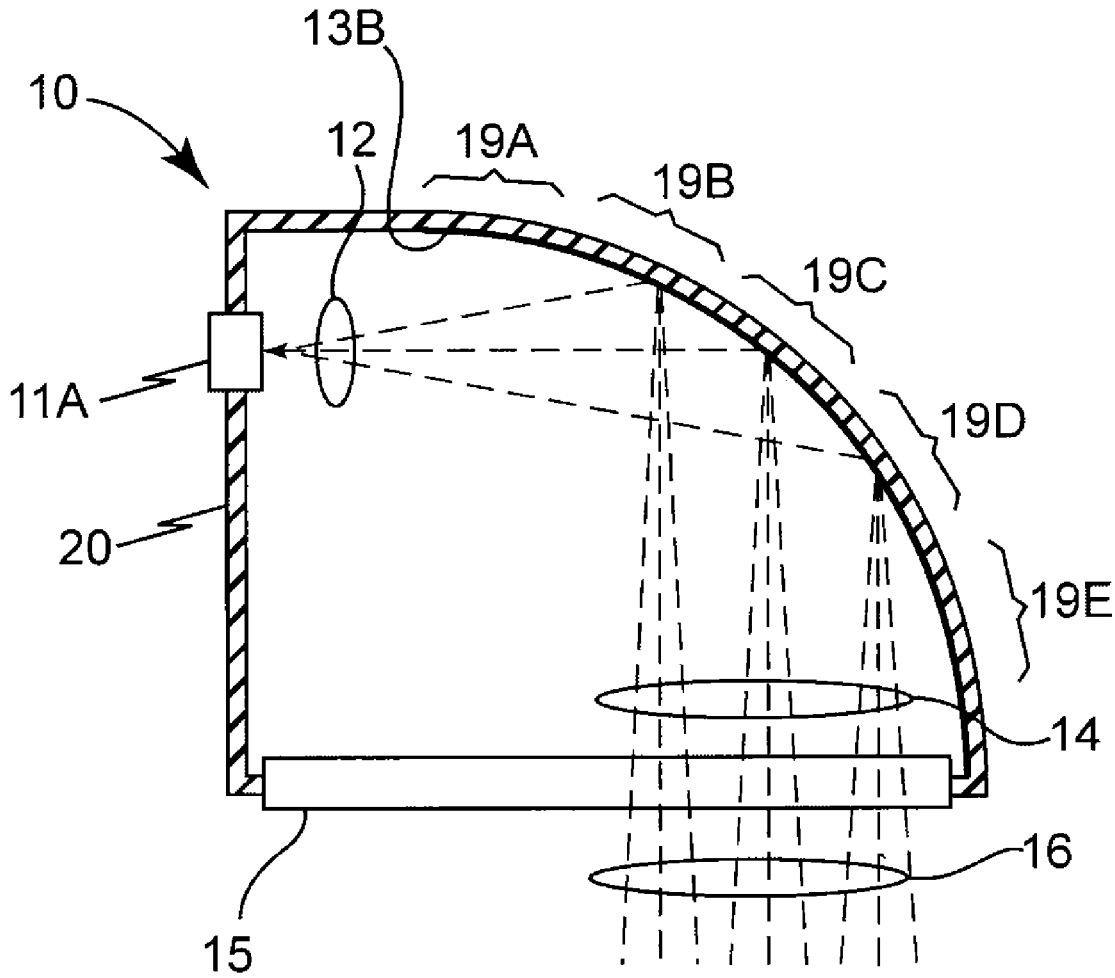
FIG. 4 is a cross-sectional schematic drawing of a simplified optical path in a rear combination lamp, having a single LED and a faceted reflector.

Compared with the schematic drawing of FIG. 2 of the simplified rear combination lamp 10, the only difference in FIG. 4 is the replacement of the simple parabolic reflector 13A with faceted parabolic reflector 13B. In general, faceted reflectors are known in the industry, and have been disclosed in the patent literature as far back as 1972 or earlier. Three such known faceted reflectors are summarized below. It will be appreciated that in addition to the three examples summarized below, any suitable faceted reflector design may be used. For the exemplary drawing in FIG. 4, each facet 19A, 19B, 19C, 19D and 19E directs light into generally the same predetermined angular range, with the full lamp output having generally the same angular range as each of the facets. In alternate embodiments, each facet may direct light into its own individual predetermined angular range, with the full lamp output including the angular contributions from all the facets.

One of the relatively early faceted reflector designs is disclosed in U.S. Pat. No. 3,700,883, titled "Faceted reflector for lighting unit", issued on Oct. 24, 1972 to Donohue et al., and incorporated by reference in its entirety herein. Donohue discloses a prescription for making the reflector, including setting the number, size, curvature and location of each facet to produce undistorted reflected images of the light source, the cumulative effective of which produces the desired illumination distribution within prescribed limits. Because true parabolic cylindrical surfaces were difficult to manufacture in 1972, Donohue includes mathematical approximations to allow for the use of circular cylindrical surfaces instead.

Another faceted reflector design is disclosed in U.S. Pat. No. 4,704,661, titled "Faceted reflector for headlamps", issued on Nov. 3, 1987 to Kosmatka, and incorporated by reference in its entirety herein. In contrast with the earlier Donohue patent that used right cylindrical surfaces, the Kosmatka patent uses right parabolic cylindrical surfaces and simple rotated parabolic surfaces.

A third known faceted reflector design is disclosed in U.S. Pat. No. 5,406,464, titled "Reflector for vehicular headlamp", issued to Saito on Apr. 11, 1995, and incorporated by reference in its entirety herein. Saito discloses a reflector that has several reflecting areas, with each reflecting area including several segments. Each segment has a basic curved surface (hyperbolic paraboloid, elliptic paraboloid, or paraboloid-of-revolution), and is laid out on a paraboloid-of-revolution reference surface having locally different focal distances.

As used in the rear combination lamp 10 of FIG. 4, the faceted reflector 13B receives the diverging beam 12 from the LED module 11A, collimates the beam and angularly diverts portions of the beam, and directs the collimated and angularly diverted beam 14 to the clear cover 15, through which it exits the lamp 10.

We summarize the optical path in the lamp 10 of FIG. 4 before discussing the mechanical package for the lamp. An LED module 11B is placed at or near the focus of a faceted parabolic reflector 13B. The LED module 11B is oriented to direct its diverging light output largely laterally. The diverging beam 12 from the LED module 11B strikes the faceted parabolic reflector, 13B so that the optical axis 17 has about a 45 degree angle of incidence, and the reflected optical axis 18 leaves the reflector at about a 45 degree angle of exitance. The incident optical axis 17 is largely horizontal and lateral, and the reflected optical axis 18 is largely longitudinal. The parabolic reflector 13B collimates the beam and reflects a collimated beam, and the facets produce a particular angular distribution to the reflected collimated beam 14. The reflected collimated beam 14 passes through the clear cover 15 and becomes the exiting beam 16 that propagates toward a viewer.

Having summarized the optical path, we now discuss the mechanical package of the rear combination lamp 10, which holds the optical components in place, delivers electrical power to the LEDs, and dissipates heat produced by the LEDs.

Figure 5:
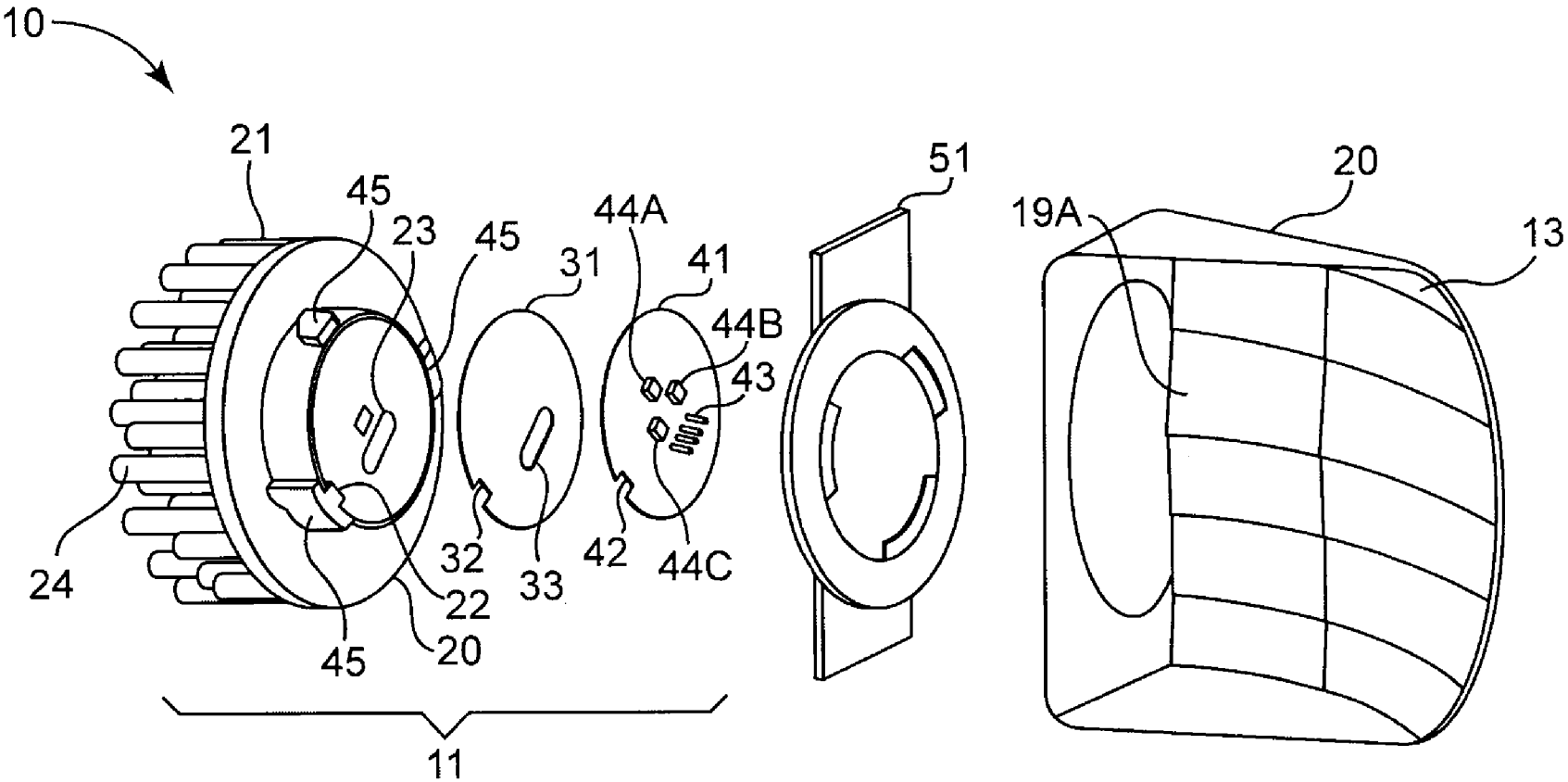
FIG. 5 is an exploded view schematic drawing of an exemplary mechanical layout of a rear combination lamp.

FIG. 5 is an exploded view schematic drawing of an exemplary mechanical layout of a rear combination lamp 10.

The light emitting diodes 44A, 44B and 44C are mounted on one side of the printed circuit board 41, so that they all emit in generally the same direction, perpendicular to the plane of the circuit board. In general, it is typical to try and mount the LEDs so that their emissions are truly parallel, but in practice there may be some small variations in the LED pointing angles due to component, manufacturing and assembly tolerances. In general, these small LED pointing errors do not create problems for the lamp 10.

The circuit board 41 includes the electrical circuitry that drives the LEDs 44A, 44B and 44C. The circuitry may be formed in a known manner, using techniques that are commonly applied to printed circuit boards. The LED driver circuit design may be a known design, such as, for example, the design from the reference cited above, U.S. Pat. No. 7,042,165, titled "Driver circuit for LED vehicle lamp", issued to Madhani et al., and assigned to Osram Sylvania Inc. of Danvers, Mass., which is incorporated by reference herein in its entirety. Alternatively, any suitable LED driver circuit may be used.

Although three LEDs are shown in FIG. 5, any suitable number of LEDs may be used, including one, two, three, four, five, eight, or any other suitable value. In general, the placement of the LEDs on the circuit board is determined by a compromise between optimizing the optical performance, which tends to group the LEDs as closely as possible, and optimizing the heat dissipation, which tends to spread the LEDs as far apart as possible.

The shape, or "footprint", of the printed circuit board 41 may be chosen arbitrarily. In the exemplary design of FIG. 5, the footprint is round, or circular. A circular printed circuit board may be convenient for mounting into other components that have general cylindrical symmetry, such as the exemplary heat sink 21 of FIG. 5. Alternatively, the printed circuit board may be square or rectangular in profile; a rectangular footprint may be conducive to reducing any wasted circuit board material during the manufacturing process. In general, any suitable shape may be used for the printed circuit board 41.

The electrical connections to and from the printed circuit board are made through one or more electrical connectors 43. Connectors such as these are convenient for quickly engaging or disengaging the circuit board. The connector 43 may be a known connector, such as those disclosed in the following two references: U.S. Pat. No. 7,110,656, titled "LED bulb", issued to Coushaine et al., and assigned to Osram Sylvania Inc. of Danvers, Mass., discloses a complementary socket and electrical connector mechanical structure for LED-based lighting modules, and is incorporated by reference herein in its entirety. U.S. Pat. No. 7,075,224, titled "Light emitting diode bulb connector including tension receiver", issued to Coushaine et al., and assigned to Osram Sylvania Inc. of Danvers, Mass., discloses another complementary socket and electrical connector mechanical structure for LED-based lighting modules, and is incorporated by reference herein in its entirety. Alternatively, any suitable connector may be used.

The circuit board 41 includes a slot or tab 42 that can engage a tab or slot 22 on the heat sink 21, so that the circuit board 41 may be easily rotationally oriented and retainably screwed/riveted onto the heat sink 21. This method of attachment provides quick, reliable placement of the circuit board, and requires no additional components or assembly steps. Alternatively, the circuit board may be attached with glue, a curable adhesive, screws, bolts, snaps, magnets, or any other suitable attachment method.

While it desirable to screw/rivet the printed circuit board 41 to the heat sink 21, so that the heat sink mechanically supports the circuit board in space, we ensure good thermal contact between the circuit board 41 and the heat sink 21 by inserting a thermal pad or "gap" pad and/or thermal grease 31 between the circuit board 41 and heat sink 21. The thermal pad 31 may have roughly the same footprint, or size and shape, as the printed circuit board 41 and may include its own tab 32 for orienting the pad rotationally with respect to the heat sink. The thermal pad may also be screwed while screwing the circuit board to the heat sink 21. In some applications, the thermal pad 31 snaps into the heat sink 21 using the same tab 22 on the heat sink; in other applications, it may use a separate tab. When the printed circuit board 41 snaps onto the heat sink 21, it secures in places the thermal pad 31.

The thermal pad 31 may include one or more holes 33 to accommodate the one or more electric connectors 43 on the printed circuit board 41.

In some applications, the thermal pad 31 has roughly the same footprint, or outer size and shape, as the printed circuit board 41. In other applications, the thermal pad 31 may be slightly larger than the printed circuit board. In still other applications, the thermal pad 31 may be slightly smaller than the printed circuit board, and may extend outward only as far as the extent of the actual circuitry on the circuit board 41.

In some applications, the printed circuit board 41 or the socket 21 may be coated with an electrically insulating material, and the thermal pad 31 may be omitted.

The heat sink 21, which may be known as a "casting socket", may be made from a thermally conducting material, such as aluminum, although any suitable thermal conductor may be used. The heat sink 21 may include a tab or slot 22 that engages with corresponding tabs or slots 32 and 42 on the thermal pad 31 and printed circuit board 41, for securing the circuit board and thermal pad to the heat sink 21.

The heat sink 21 may have its own electrical connections, for connecting to connector 43 on the circuit board, or may have one or more holes 23 that can accommodate the connector 43.

The heat sink 21 may have optional fins 24 for dissipating heat generated by the LEDs 44A-C and the circuitry on the circuit board 41.

Alternatively, the heat sink may be a separate part from the casting socket, or an optional part with fins may be brought into contact with the casting socket during assembly of the lamp 10.

Taken together, the heat sink 21, the thermal pad 31 and the printed circuit board 41 correspond to the "LED module" 11A and 11B from FIGS. 2-4.

Once the thermal pad 31 and printed circuit board 41 are attached to the heat sink 21, the LED module 11 may be attached to an adapter 51, which in turn may be attached to a housing 20. Alternatively, the quarter turn adapter may be manufactured directly on the housing 20, so the LED module 11 can be pushed into the reflector and rotated a quarter turn to fix it position. The order of assembly of these components may be altered as suitable for the particular manufacturing process.

The housing 20 may be a single part that includes the curved and faceted surface of the reflector 13, which may optionally include additional reflective coatings on it, as well as adjacent flat surfaces for mounting and interfacing with additional components. The housing 20 includes a flat surface that is perpendicular to the cylindrical or longitudinal axis of the heat sink 21, which mechanically supports the adapter 51 and the LED module 11 when assembled.

The housing 20 may be made from any suitable material, such as metal, plastic, or any other suitable material or combination of materials.

The lamp 10 may also include a clear cover on its front face, which is not shown in the figures. Such a clear cover may optionally include one or more sealing features, to protect the other components from the elements.

Figure 6:
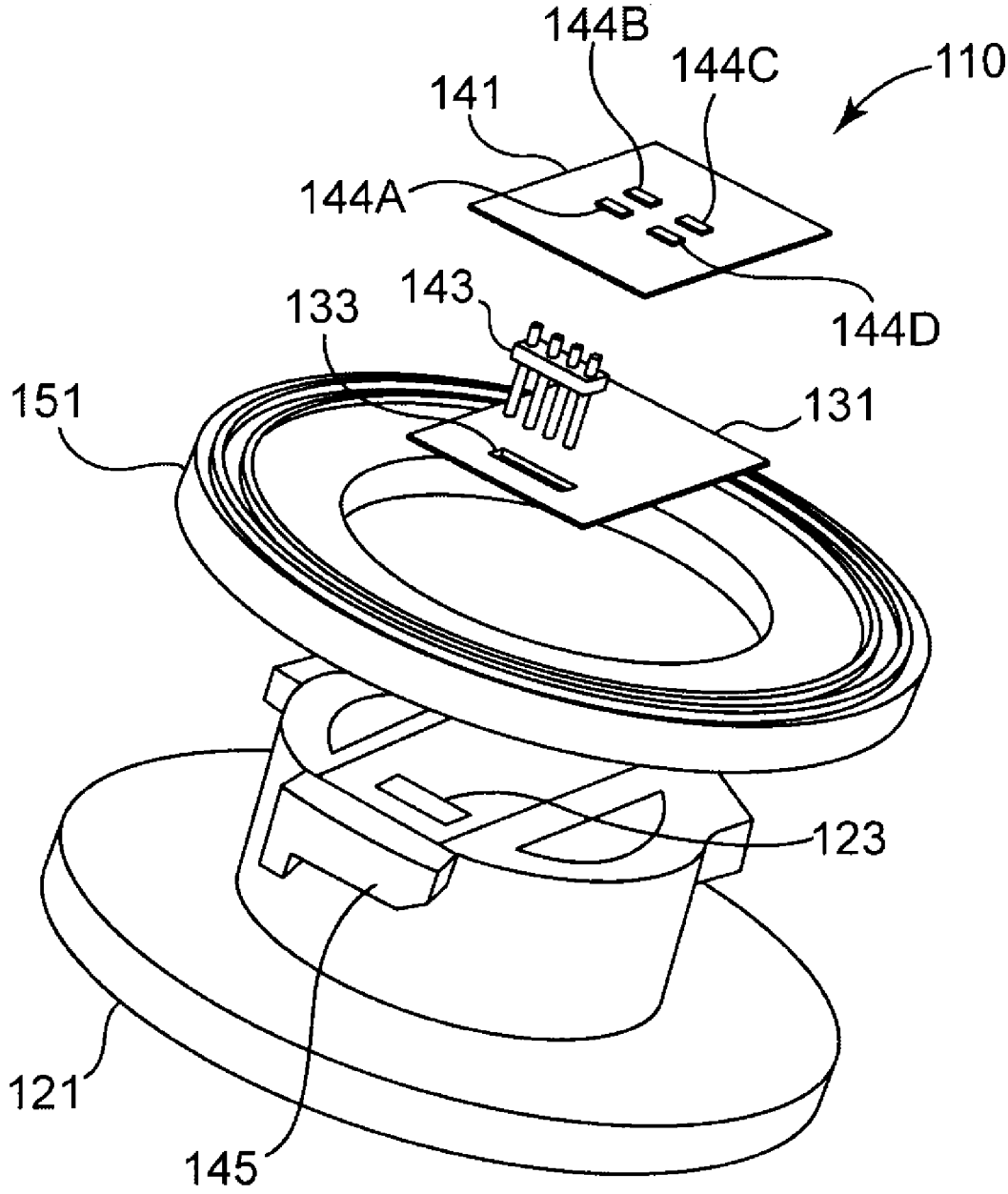
FIG. 6 is an exploded view schematic drawing of an exemplary mechanical layout of an LED module.

FIG. 6 is an exploded view of another mechanical design for the LED module 110.

A heat sink, which may be known as a housing 121, may be made from a thermally conducting material, such as aluminum. The heat sink 121 may include a variety of mounting or interfacing surfaces for accommodating a printed circuit board 141 and thermal pad 131, and a seal gasket 151.

The printed circuit board 141 and thermal pad 131 may be similar in construction to those used in FIG. 5. This particular exemplary circuit board may have four LEDs 144A, 144B, 144C and 144D, arranged in a square, although any suitable number and layout of LEDs may alternatively be used. The circuit board 141 may receive its electrical power via an electrical connector 143, and the thermal pad 131 and heat sink 121 may both have one or more holes 133 and 123 that can accommodate the connector 143. The printed circuit board 141 and thermal pad 131 may optionally have the same footprint, rectangular in the exemplary design in FIG. 6, and may optionally include one or more snap features so that they may be snapped onto the heat sink during assembly.

The seal gasket 151 may be circular or any other suitable shape, and may be made from plastic, metal, rubber or any other suitable material that can form a seal.

When assembled, the LEDs are at the focal plane of the parabolic reflector. The LEDs emit diverging light that is collimated by the reflector, which reflects a collimated beam that exits the lamp through the clear cover on the front face of the lamp.

Finally, we compare the rear combination lamp disclosed herein with several known rear combination lamp designs that have sockets that open to the side, and show a clear advantage over these known designs.

Three lighting systems that have sockets that open to the side are disclosed in, for example, U.S. Pat. Nos. 6,637,923, 6,814,475 and 6,951,414, all issued to Amano and assigned to Koito Manufacturing Co. All three include an element adjacent to the LED that collimates the beam, and then a separate element that receives the collimated beam and reflects the collimated beam outward away from the automobile.

As an example, consider the '923 patent. In '923, an LED light source 30 is mounted facing upward, so that its peak light output is directed upward. A Fresnel lens 32 is mounted adjacent to the LED light source and collimates the light from the LED, so that the beam emerging from the Fresnel lens 32 is generally collimated. Note that a collimated beam may be known as "parallel light flux" in much of the literature. The LED and the optical axis of the Fresnel lens are aligned so that the emergent collimated beam travels generally upward. The beam then reflects off a reflector 24 that directs it to the front of the lamp (or, equivalently, the rear of the vehicle). In some of the figures in '923, there is an additional "deflection lens element" 32*b*, 32*c* between the Fresnel lens 32 and the reflector 24 that can vary the propagation direction of the collimated beam slightly away from upward.

Similar structures exist in '475 (Fresnel lens 32 and reflector 26) and in '414 (lens 14, referred to as "optical member 14", and reflector 16).

One potential drawback to the lighting systems of these three references is that two separate elements are used to collimate and then reflect the beam. These separate elements may be costly to fabricate, costly and time-consuming to align, and may introduce unnecessary loss into the optical system (i.e., some light may be absorbed, reflected and/or scattered out of the output beam by the multiple elements).

In contrast, the designs disclosed herein have no such intermediate optical element between the LEDs and the reflector. The collimating function of the Fresnel lenses in the cited references has been absorbed by the reflectors 13A and 13B of the present application. This provides a distinct advantage over the cited references, because a component of the references has been eliminated, while the functionality of the eliminated component is maintained by the present device. This allows for a reduction in component assembly and alignment costs, and a reduction in optical loss that may be caused by reflections, scattering and absorption from the eliminated component.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A vehicular lamp (10), comprising:

a thermally conductive module (21, 121) having a longitudinal axis and being insertable into a housing (20) along the longitudinal axis;

a printed circuit board (41, 141) in mechanical and thermal contact with the thermally conductive module (21, 121), the printed circuit board (41, 141) being oriented generally perpendicular to the longitudinal axis;

at least one light emitting diode (44, 144) mounted on the printed circuit board (41, 141) and controlled electrically by the printed circuit board (41, 141), the at least one light emitting diode to emit a diverging beam (12) generally parallel to the longitudinal axis; and a curved and faceted reflector (13) being constructed to receive the diverging beam (12) and to reflect a generally collimated beam (14) along the longitudinal axis;

wherein the curvature of the reflector (13) collimates the received diverging beam (12); and each facet on the reflector (13) is constructed to angularly divert a corresponding portion of the reflected collimated beam (14) into a predetermined angular range.

2. The vehicular lamp (10) of claim 1, further comprising a thermal pad (31, 131) disposed between the printed circuit board (41, 141) and the thermally conductive module (21, 121), the thermal pad (31, 131) and the printed circuit board (41, 141) having essentially the same footprint.

3. The vehicular lamp (10) of claim 2, wherein the thermal pad (31, 131) and the printed circuit board (41, 141) both snap onto the thermally conductive module (21, 121).

4. The vehicular lamp (10) of claim 2, wherein the thermal pad (31, 131) includes a hole (33, 133) to accommodate electrical connections to the printed circuit board (41, 141).

5. The vehicular lamp (10) of claim 1, wherein the thermally conductive module (21, 121) is made from aluminum.

6. The vehicular lamp (10) of claim 1, wherein the thermally conductive module (21) includes a plurality of fins (24) on the side opposite the printed circuit board (41).

7. The vehicular lamp (10) of claim 1, wherein the curvature of the reflector (13) comprises a portion of an off-axis paraboloid.

8. The vehicular lamp (10) of claim 1, wherein the predetermined angular range is within +/−10 degrees vertically and within +/−20 degrees laterally.

9. The vehicular lamp (10) of claim 1, further comprising a transparent cover (15) to transmit the generally collimated beam (14).

10. A vehicular lamp (10), comprising:

a light emitting diode (44, 144) to emit a diverging beam (12) along an optical axis;

a generally planar printed circuit board (41, 141) to power the light emitting diode (44, 144) and to mechanically mount the light emitting diode (44, 144), the printed circuit board (41, 141) being generally perpendicular to the optical axis;

a generally cylindrical module (21, 121) in mechanical and thermal contact with the circuit board (41, 141), the module (21, 121) having a cylindrical axis generally parallel to the optical axis;

a fixture (20) to mount the module (21, 121), the module (21, 121) being mounted so that the cylindrical axis is horizontal and is generally parallel to a front of the fixture;

a reflector (13) being constructed to receive the diverging beam (12) and to emit a generally collimated beam (14) generally perpendicular to the front of the fixture (20), the reflector (13) comprising a faceted portion of an off-axis paraboloid, the reflector (13) having a focal plane that includes the light emitting diode (44, 144), the reflector (13) facets being constructed to angularly divert the collimated, reflected light into a predetermined angular range; and a transparent cover (15) to transmit the generally collimated beam (14).

11. The vehicular lamp (10) of claim 10, further comprising:

a thermal pad (31, 131) disposed between the printed circuit board (41, 141) and the module (21, 121) to provide thermal contact between the printed circuit board (41, 141) and the module (21, 121);

wherein the thermal pad (31, 131) and the printed circuit board (41, 141) have the same footprint and are both connected onto the module (21, 121).

12. The vehicular lamp (10) of claim 10, further comprising a plurality of light emitting diodes (44, 144) at the focal plane of the reflector (13), each light emitting diode (44, 144) in the plurality emitting diverging light along the optical axis, the diverging beam (12) being formed from diverging light emitted from all light emitting diodes (44, 144) in the plurality.

13. The vehicular lamp (10) of claim 8, wherein the module (21, 121) is replaceable by a longitudinal insertion of the module (21, 121) along the cylindrical axis into a lateral side of the fixture (20).

14. A vehicular lamp (10), comprising:

a light emitting diode (44, 144) to emit a diverging beam (12) along a lateral direction;

a reflector (13) being constructed to receive the diverging beam (12) and to reflect a generally collimated beam (14) along a longitudinal direction, the longitudinal direction being generally perpendicular to the lateral direction, the reflector (13) being a faceted paraboloid, each reflector (13) facet being constructed to angularly divert the reflected collimated light into a predetermined angular range centered about the longitudinal direction, light emitting diode (44, 144) being disposed in a focal plane of the reflector (13);

a transparent cover (15) to transmit the generally collimated beam (14) in the longitudinal direction; and a module (21, 121) to mechanically mount, electrically power, and thermally connect to the light emitting diode (44, 144);

wherein the module (21, 121) is laterally mounted and comprises:

a heat sink;

a printed circuit board (41, 141) to electrically power the light emitting diode (44, 144), the circuit board (41, 141) being generally planar and perpendicular to the lateral direction; and a thermal pad (31, 131) disposed between the printed circuit board (41, 141) and the heat sink to provide thermal contact and electrical insulation between the printed circuit board (41, 141) and the heat sink.

15. The vehicular lamp (10) of claim 14, wherein the thermal pad (31, 131) and the printed circuit board (41, 141) have the same footprint and are connected into the module (21, 121).

16. The vehicular lamp (10) of claim 14, wherein the module (21, 121) is replaceable by a motion along the lateral direction.

17. The vehicular lamp (10) of claim 1, wherein the diverging beam (12) reaches a reflecting surface of the reflector (13).

18. The vehicular lamp (10) of claim 10, wherein the diverging beam (12) reaches a reflecting surface of the reflector (13).

19. The vehicular lamp (10) of claim 14, wherein the diverging beam (12) reaches a reflecting surface of the reflector (13).

* * * * *

UNITED STATES PATENT AND TRADEMARK OFFICE

CERTIFICATE OF CORRECTION

PATENT NO. : 7,905,639 B2
APPLICATION NO. : 12/259633
DATED : March 15, 2011
INVENTOR(S) : Luo et al.

It is certified that error appears in the above-identified patent and that said Letters Patent is hereby corrected as shown below:

On the title page, the second inventor of item [75] Inventors:
ZhaoHuan Liu, Mississauga, CA (US) should read -- ZhaoHuan Liu, Mississauga (CA) --.

Signed and Sealed this
Twenty-first Day of June, 2011

David J. Kappos

David J. Kappos
*Director of the United States Patent and Trademark Office*